US006575151B2

(12) United States Patent
Murata et al.

(10) Patent No.: US 6,575,151 B2
(45) Date of Patent: Jun. 10, 2003

(54) IGNITION COIL FOR INTERNAL COMBUSTION ENGINE

(75) Inventors: Shigemi Murata, Tokyo (JP); Mitsuru Koiwa, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 183 days.

(21) Appl. No.: 09/727,768

(22) Filed: Dec. 4, 2000

(65) Prior Publication Data

US 2002/0007828 A1 Jan. 24, 2002

(30) Foreign Application Priority Data

Jun. 15, 2000 (JP) ..... 2000-179765

(51) Int. Cl.[7] ..... F02P 1/00
(52) U.S. Cl. ..... 123/647; 336/96
(58) Field of Search ..... 123/647, 634, 123/635, 594, 599, 644; 336/96

(56) References Cited

U.S. PATENT DOCUMENTS 5,485,825 A 1/1996 Shimizu et al. ..... 123/634
5,758,624 A * 6/1998 Satou et al. ..... 123/634
5,915,367 A * 6/1999 Oishi et al. ..... 123/635
5,977,856 A * 11/1999 Maekawa et al. ..... 123/634
6,005,464 A * 12/1999 Sakamaki et al. ..... 123/634
6,055,969 A * 5/2000 Oishi et al. ..... 123/635
6,252,482 B1 * 6/2001 Chiba et al. ..... 123/634
6,378,514 B1 * 4/2002 Kaminaga et al. ..... 123/633

FOREIGN PATENT DOCUMENTS

JP 3039423 4/1997 ..... H01F/30/00

* cited by examiner

*Primary Examiner*—John Kwon
(74) *Attorney, Agent, or Firm*—Sughrue Mion, PLLC

(57) ABSTRACT

An ignition coil for an internal combustion engine with a compact height and width includes an actuated magnetic portion of an iron core around which a primary coil is wound having an axis line crossing an ignition plug axis line of the internal combustion engine at a right angle; and a switching unit which is disposed at an end of the actuated magnetic portion vertically to the axis line of the actuated magnetic portion and intercepts a primary current flowing through the primary coil. This ignition coil can be manufactured at a greatly reduced cost, compared to the conventional ignition coil in which only one of the height or width is made compact, by reducing the required size of the press mold for the case and by reducing the initial investment for the equipment.

9 Claims, 9 Drawing Sheets

PRIOR ART

IGNITION COIL FOR INTERNAL COMBUSTION ENGINE

BACKGROUND OF THE INVENTION

1. Field of the Invention

The present invention relates to an ignition coil for an internal combustion engine to make a sparkling discharge on a ignition plug of the internal combustion engine such as a vehicle engine.

2. Description of Related Art

FIG. 6 shows a cross sectional view of a conventional ignition coil of an internal combustion engine disclosed in Japanese Utility Model Registration No. 3039423.

In the drawing there are shown an iron core 1 forming closed magnetic circuit, a gap 1*a* formed in the closed magnetic circuit, an actuated magnetic portion 1*b* of the iron core around which an primary coil 2 and secondary coil 3 are wound and the axis line 1*c* of the actuated magnetic portion of the iron core. The primary coil 2 is wound around a primary bobbin 2*a* and aligned. The secondary coil 3 also wound around a secondary bobbin (not shown) and aligned.

An switching unit 4 is disposed in parallel with the actuated magnetic portion 1*b* and provided with switching element 4*a* such as bipolar transistor and IGBT or the like. The primary coil 2 and a terminal 5*a* of a connector 5 are connected electrically one another with a conductor 6. A high voltage tower 7 outputs an electrical high voltage generated at the secondary coil 3. After the above described elements are disposed in a case 8, they are hardened stiffly in an oven together being immersed in vacuum by injection of a resin 9 through an opening 8*a* of case 8.

FIG. 7 shows a preferred embodiment of the ignition coil, described in FIG. 6, mounted to the internal combustion engine.

The drawing shows ignition coil 10 described in FIG. 6, the internal combustion engine 11, the ignition plug 11*a*, an axis line 11*b* of the ignition plug corresponding to the direction of screwing the ignition plug into the internal combustion engine and an adapter 10*a* connected to the ignition coil 10 wherein it is provided with conductor 10*b* inside and connects a ignition plug 11*a* with ignition coil 10 disposed inside a plug hole 11*c*. The ignition coil 10 is disposed at the top of the ignition plug of each cylinder lid wherein the axis line 1*c* of the actuated magnetic portion of the iron core and an axis line 11*b* of the ignition plug are perpendicular to each other.

For example, in the case where, as DOHC engine shown in FIG. 8, the ignition coil 10 is mounted in a narrow gap between the projections of the cam shield 50 used for the suction and exhaust, the switching unit 4 is disposed at the top of the actuated magnetic portion 1*b* being parallel to the axis line 1*c* of the actuated magnetic portion as shown in FIG. 9. The total width of the ignition coil may be minimized into minimum dimension $L_W$ excluding the dimension of the switching unit 4.

In case of mounting the ignition coil 10 to the internal combustion engine of the vehicle of which the hood 51 is low, as shown in FIG. 10, the total height of the IG coil needs to be decreased. As shown in FIG. 11 the switching unit 4 is disposed at the opposite side against the corresponding surface 1*d* of the iron core, sandwiching the activated magnetic portion 1*b*, being parallel to the axis line 1*c* of the activated magnetic portion. By this way the total hight of the ignition coil may be minimized into minimum dimension $L_H$ excluding the dimension of the switching unit 4.

The motion of the ignition coil will be described according to the FIG. 12.

Synchronizing to the ON OFF motion of the ignition signal generated from an engine control unit 20, the switching element 4*a* repeats the ON and OFF of the primary current to the primary coil 2. When the primary current starts to flow, the current is not dashed but increased in the form of chopping waves proportional to the time of the current flow by an inductance of a magnetic circuit and the primary current is intercepted instantly by the OFF motion of the ignition signal. In the primary coil 2 an electromotive force is generated at the interception of the primary current. In the secondary coil 3, a high voltage is generated proportional to the multiple number of the turns of both the primary coil 2 and the secondary coil 3, this high voltage is supplied to the ignition plug 11*a* through the high voltage tower 7 and the adapter conductor 10*b*.

A center electrode supplied the high voltage from the ignition coil and a side electrode connected to the earth are disposed at the top end of the ignition plug 11*a* and begins the discharge electricity when the air mixture of the fuel between the electrodes caused an isolation breakage by the supplied high voltage. This discharge is called the inductive discharge. The energy supplied from the primary coil of the ignition coil is injected in a mixed air in each cylinder of the internal combustion engine and forms the firing source in the discharge channel and grows it and finally sets fire to the fuel. The output voltage and energy of the ignition coil are almost proportional to the interception current value of the primary current, therefor in result it is proportional to the flowing time of the electricity.

In the process of being converted to the magnetic energy of the iron core, the energy supplied from the primary coil 2 is limited by the magnetic flux saturation of the iron core 1. The maximum magnetic flux density of the iron core 1 is "magnetic flux density of the magnetic material used for the iron core for instance silicon steel plate etc."×"an area of the iron core section." At the present time the required energy for the engine not requiring the large output energy of the ignition coil especially is about 23 mJ and as for the lean burn engine which appears in recent years and the engine which emits a jet inside the cylinder, the required energy is about 45 mJ. As the result of examining it based upon the iron core used for the ignition coil, it is recognized that required section area of the iron core of the actuated magnetic portion is more than 50 $mm^2$. This area may realize the energy of more than 23 mJ.

Disposing the magnet in the gap with the polarity having an opposite magnetic direction against the actuated magnetic direction of the primary coil and using it from the condition in which the iron core is saturated in the magnetic field having opposite direction against the actuated magnetic direction, the energy accumulated in the magnetic circuit becomes twice as much. This method may realize the energy of about 45 mJ.

BRIEF SUMMARY OF THE INVENTION

Object of the Invention

One of the main elements defining the length of the ignition coil axis direction is the turning length of the primary coil. It corresponds to the dimension $L_0$ in FIG. 6. For example in the prior art, the primary coil 2 wound by 150T having the maximum finished outside dimension is about 0.5 mm. In a primary bobbin 2*a* the coil should be a multiple layer like double layers or four layers because the starting position and the ending one of the coil should be coincides with each other. In the prior art the ignition coil has double layer and the length $L_0$ of the winding wire is 0.55 mm×(150T/2 layer)=37.5 mm. As the length $L_1$ of the case is about 45 mm, it is recognized that about 90% of it are the dimension of the primary coil.

The cylinder span $L_k$ (FIG. 7) of the internal combustion engine of around 1500 cc vehicle is about 90 mm, therefor in the case of mounting the conventional ignition coil shown in FIG. 6 at the condition shown in FIG. 7, considering:

Case length $L_1$+dimension to mount the iron core $L_2$: 16 mm+connector dimension length $L_3$: 22 mm+allowance of the dimension for insertion and removal: 10 mm, it is recognized that there is no more space.

If we design the ignition coil acceptable for the cylinder span $L_K$ of about 105 mm based upon the consideration of a big cylinder span engine, it is necessary to keep the case length $L_1$ within 60 mm.

The small diameter of the primary coil will bring a short winding wire length $L_0$, but the resistance value of the primary coil will increase. In the case of where the voltage of the battery is low at the start of the internal combustion engine, the resistance limits the primary current. Because of the above-described reason enough interception current is not prepared to get the necessary characteristics. Therefor the best diameter of the primary coil exists.

In the system of the individual ignition disposing the ignition coil at the top of the ignition plug of each cylinder, the axis direction length of the ignition coil is limited because of the limitation of the cylinder span of the internal combustion engine. In the case of using the ignition coil which includes the switching unit 4 within it, the position should be kept parallel to the axis line 1*c* of the actuated magnetic portion 1*b* of the iron core.

In the conventional product the switching unit 4 including the switching element 4*a* inside it and the axis line 1*c* of the actuated magnetic portion 1*b* of the iron core are disposed in parallel each other therefore we had to prepare two kinds of product to dispose the switching unit 4 at the suitable position for both the case of internal combustion engine layout requiring the shortening the total width $L_W$ of the ignition coil as shown in FIG. 8 and the case of internal combustion engine layout requiring the decreasing the total height $L_H$ of the ignition coil shown in FIG. 10. In near future when the kinds of the product are increased we have to increase the press mold for the case and investment for the equipment corresponding to the many kinds of product. It is the great disadvantage for the production cost.

The object of the present invention is the improvement of the above disadvantage. We can apply only one type of the ignition coil for both the case of internal combustion engine layout requiring the shortening the total width of the ignition coil and the case of internal combustion engine layout requiring the decreasing the total height of the ignition coil. Furthermore we submit the product enable to mount it in a severe layout of the internal combustion engine which is limited both for the height and the width. As the result it is the object of the present invention to get the ignition coil for the internal combustion engine which is enable to reduce the cost greatly by reducing the kind of the press mold for the case and investment for the equipment by reducing the kinds of products, and reducing the labor cost for the production process and increase the production quantity for the each equipment.

SUMMARY OF THE INVENTION

"An ignition coil for an internal combustion engine according to a first embodiment of the invention includes: an actuated magnetic portion of an iron core which has an axis line crossing an ignition plug axis line of the internal combustion engine at a right angle and around which a primary coil is wound; and a switching unit which is disposed at an end of the actuated magnetic portion vertically to the axis line of the actuated magnetic portion and flows and intercepts a primary current flowing through the primary coil."

"The ignition coil for an internal combustion engine according to this embodiment of the invention further comprises a cross section area of the iron core being 50 $mm^2$ or larger."

"The ignition coil for an internal combustion engine according to the first embodiment of the invention further comprises a case that has the actuated magnetic portion and the switching unit built-in, in which a length of the case in an axis line direction of the actuated magnetic portion is shorter than 60 $mm^2$."

"The ignition coil for an internal combustion engine according to the first embodiment of the invention has an iron core made of a magnetic steel plate having direction characteristics in the axis line direction of the actuated magnetic portion the actuated magnetic portion."

"The ignition coil for an internal combustion engine according to the first embodiment has a switching element in the switching unit that intercepts a current at 7.5A or larger."

"The ignition coil for an internal combustion engine according to the first embodiment of the invention has an iron core which is a closed magnetic circuit iron core having a gap."

"The ignition coil for an internal combustion engine according to the first embodiment of the invention has an iron core made of a closed magnetic circuit iron core having a gap, in which the gap of the closed magnetic circuit iron core is formed outside of the actuated magnetic portion."

"The ignition coil for an internal combustion engine according to the first embodiment of the invention further comprises a side iron core portion which is connected to the actuated magnetic portion at a part of the closed magnetic circuit iron core and is disposed between the actuated magnetic portion and the switching unit. This side iron core portion has a cross section that is almost equal to that of the actuated magnetic portion, in which a cross section shape of the side iron core portion is a rectangular shape having a shorter side extending in the direction of the axis line of the actuated magnetic portion."

"The ignition coil for an internal combustion engine according to a second embodiment of the invention includes: an actuated magnetic portion of an iron core which has an axis line crossing an ignition plug axis line of the internal combustion engine at a right angle and around which a primary coil is wound; and a switching unit which is disposed at an end of the actuated magnetic portion vertically to the axis line of the actuated magnetic portion and flows and intercepts a primary current flowing through the primary coil, in which the iron core is an open magnetic circuit iron core."

DETAILED DESCRIPTION OF THE PREFERRED EMBODIMENTS

Embodiments of the present invention will be described below according to the drawings.

Embodiment 1

Figure 1:
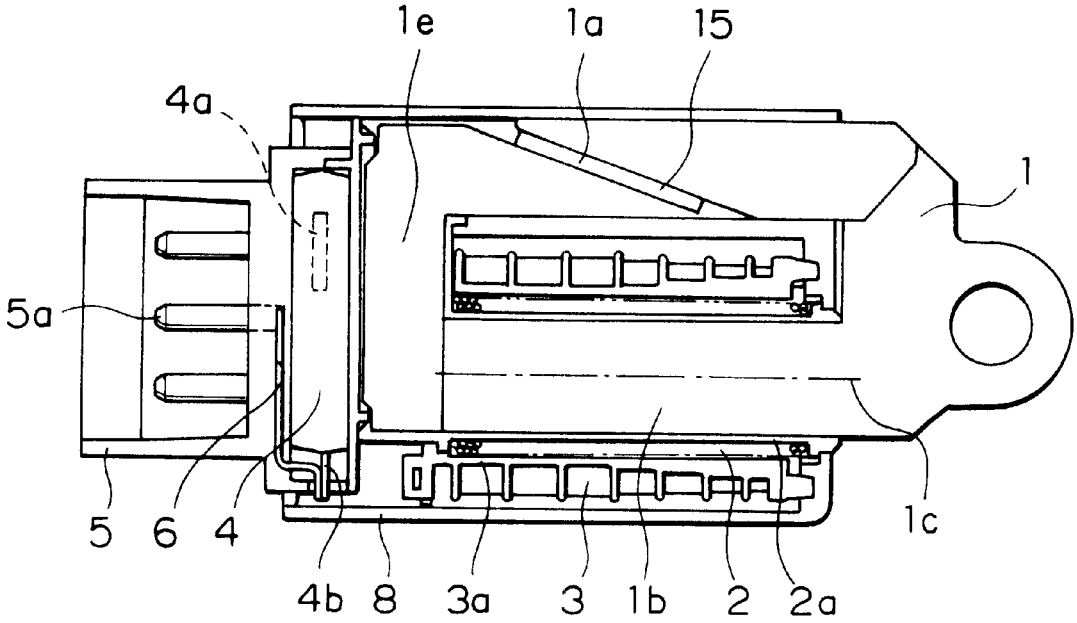
FIG. 1 is a plain cross sectional view showing an ignition coil for an internal combustion engine according to Embodiment 1 of the present invention.
Figure 2:
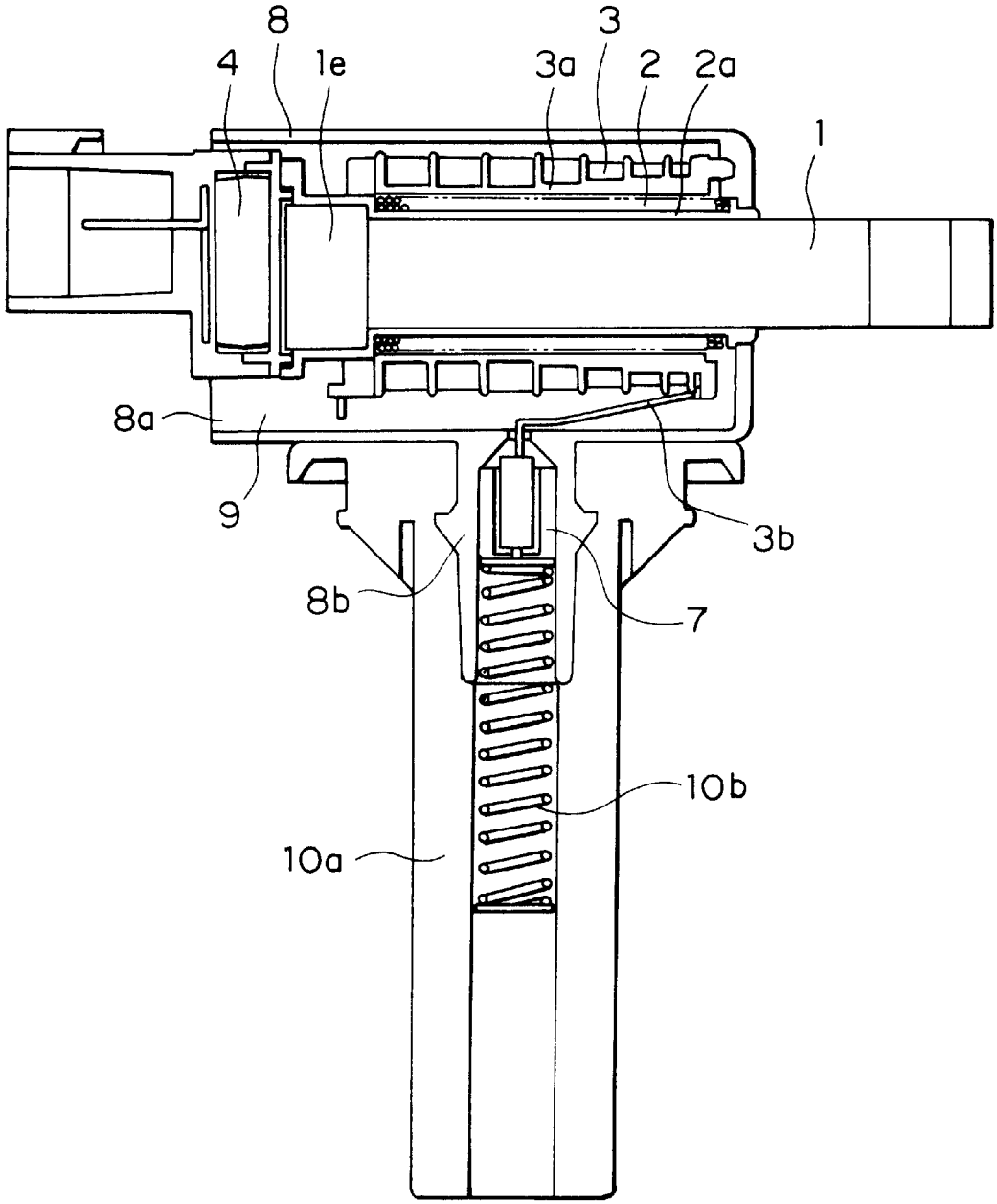
FIG. 2 is a side cross sectional view showing the ignition coil for an internal combustion engine according to Embodiment 1 of the present invention.

FIG. 1 is a cross sectional plain view shown the ignition coil of the internal combustion engine according to the embodiment of the present invention. FIG. 2 is a cross sectional side view of FIG. 1.

FIG. 1 shows an iron core 1 forming closed magnetic circuit, a gap 1*a* formed in the closed magnetic circuit, an actuated magnetic portion 1*b* of the iron core around which an primary coil 2 and secondary coil 3 are wound and the axis line 1*c* of the actuated magnetic portion of the iron core. The material of the iron core 1 is a magnetic steel plate having the axis direction characteristics toward the axis line 1*c* of the actuated magnetic portion. The cross section area of the iron core 1 is more than 50 $mm^2$. The output energy of the ignition coil corresponding to the required energy for the engine can be obtained easily. The gap 1*a* is formed outside of the actuated magnetic portion 1*b* of the iron core. The magnet 15 is disposed in the gap 1*a* with the polarity having an opposite magnetic direction against the actuated magnetic direction of the iron core of the primary coil 2.

A part of the closed magnetic circuit iron core 1*e* connects to the actuated magnetic portion 1*b* and is disposed between the actuated magnetic portion 1*b* and the switching unit 4, providing with the side iron core of which the cross section is almost equal to that of the actuated magnetic portion. The form of the cross section of the side iron core is a rectangular shape of which the short axis line coincides with the direction of the axis line of the actuated magnetic portion.

The primary coil 2 is wound around a primary bobbin 2*a* and aligned. The secondary coil 3 also wound around a secondary bobbin 3*a* and aligned. An switching unit 4 is disposed at the end portion of the actuated magnetic portion 1*b* vertically to the axis line 1*c* of the actuated magnetic portion and provided with a switching element 4*a* therein such as bipolar transistor, IGBT or the like. The element of the switching unit 4*a* intercepts the current at more than 7.5A. The reference numeral 8 denotes the case which receives each part. The axis line length of the above-described actuated magnetic portion of the case 8 is within 60 mm and by this reason it may be applied to any size of the cylinder span engine.

The drawing shows the connector 5 and the terminal 5*a* of the connector 5. The secondary coil 2, the terminal 5*a* of the connector 5 and the connecting terminal 4*b* of the switching unit 4 are connected electrically by the conductor 6.

FIG. 2 shows the high voltage tower 7 connected to the secondary coil 3 through the terminal 3*b* and the high voltage tower 8*b* forming a part of the case 8 connected to the adapter 10*a*. The adapter 10*a* is made from an isolation rubber and comprising of the conductor 10*b* therein and connected to the ignition plug (not shown). Reference numeral 9 denotes the injection resin which fixes each part in the case and isolates electrically.

The operation of Embodiment 1 is same as the conventional one. Therefore the detailed description will be omitted.

Figure 5:
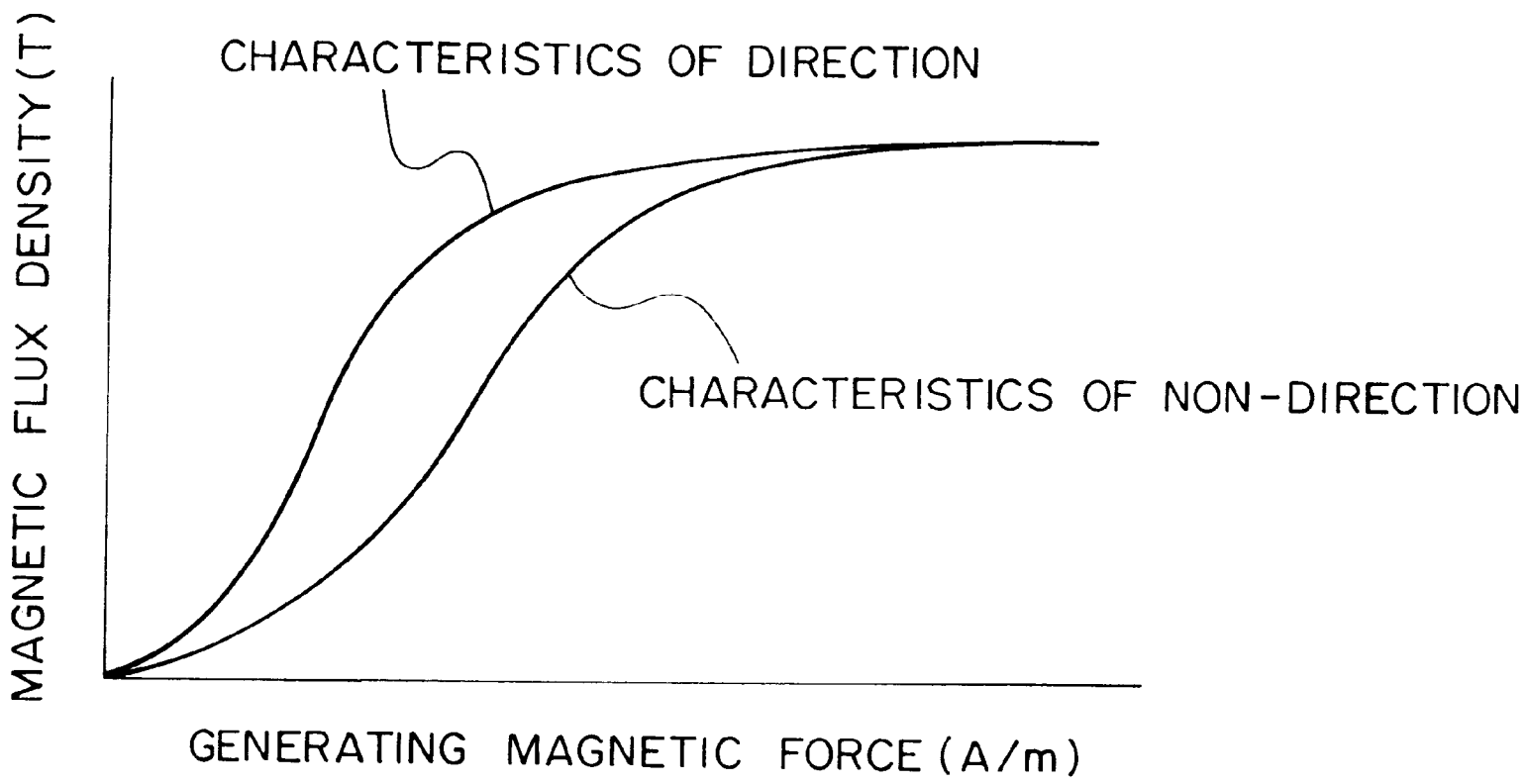
FIG. 5 is a graphical representation showing a relation between generating magnetic force and magnetic flux density in a silicon steel plate with characteristics of direction and non-direction.

An action of each part of the ignition coil will be described in this embodiment. FIG. 5 shows the relation between the generating magnetic force and the magnetic flux density in the silicon steel plate having both the characteristics of the direction and non-direction.

The iron core of this embodiment uses the material of the magnetic steel plate having the characteristics of the direction coinciding with the axis line 1*c* of the actuated magnetic portion. Therefore the magnetic flux density of the iron core becomes high rapidly comparing with the case of using non-direction magnetic steel plate.

Normally Generating magnetic force (A/m)=Turn number of primary coil n×Primary current I1

Therefore when the primary current is constant the less turn number of the primary coil may get the predetermined magnetic flux density. Accordingly the winding length $L_0$ of the primary coil may be shortened.

In this embodiment, the element of the switching unit 4 which intercepts the current at the high current more than 7.5A is used. As mentioned above:

Generating magnetic force of primary coil (A/m)=Turn number of primary coil n×Primary current I1

Therefore when we use it at about 6.5A of the conventional ignition coil, the same generating magnetic force may be obtained by 85% of the turn number of the primary coil. The less turn number of the primary coil may get the predetermined magnetic flux density. Accordingly the winding length $L_0$ of the primary coil may be shortened.

The gap 1*a* of the closed magnetic iron core of this embodiment is formed outside of the actuated magnetic portion 1*b*. When the gap disposed inside the actuated magnetic portion the efficiency of the magnetic circuit is decreased because the magnetic flux is leaked from the primary coil by the influence of the leaked magnetic flux in the gap. As the result, it is recognized by the experiment that at least 10% of the output energy is lost. When the gap 1*a* is disposed inside of the actuated magnetic portion, unless more coils are wound, energy cannot be obtained which is equal to that in the case where there is the gap 1*a* outside. In this embodiment, as the gap 1*a* is formed outside of actuated magnetic portion 1*b*, the less turn number of the primary coil may obtain the same energy. Accordingly the winding length $L_0$ of the coil may be shortened.

In this embodiment of the present invention by using the above-described technology the turn number of the primary coil may be reduced and the winding length of the primary coil may be shortened greatly comparing with the conventional ignition coil. And the switching unit 4 is disposed in the axis direction of the emptied space.

In the case of mounting the switching unit 4 at the end of the axis line of the actuated magnetic portion, it is suitable for the switching unit 4 to be arranged vertically to the axis line of the actuated magnetic portion through the side iron core portion 1*e* of the closed magnetic circuit iron core. At that time the cross section area of the side iron core 1*e* is defined same as that of the actuated magnetic portion 1*b*. And the form of the cross section of the side iron core is a rectangular shape of which the short axis line coincides with the direction of the axis line of the actuated magnetic portion, the efficiency is kept at the same level because the cross section area of the magnetic circuit is not changed and Furthermore the total length of the ignition coil may be reduced.

Figure 9:
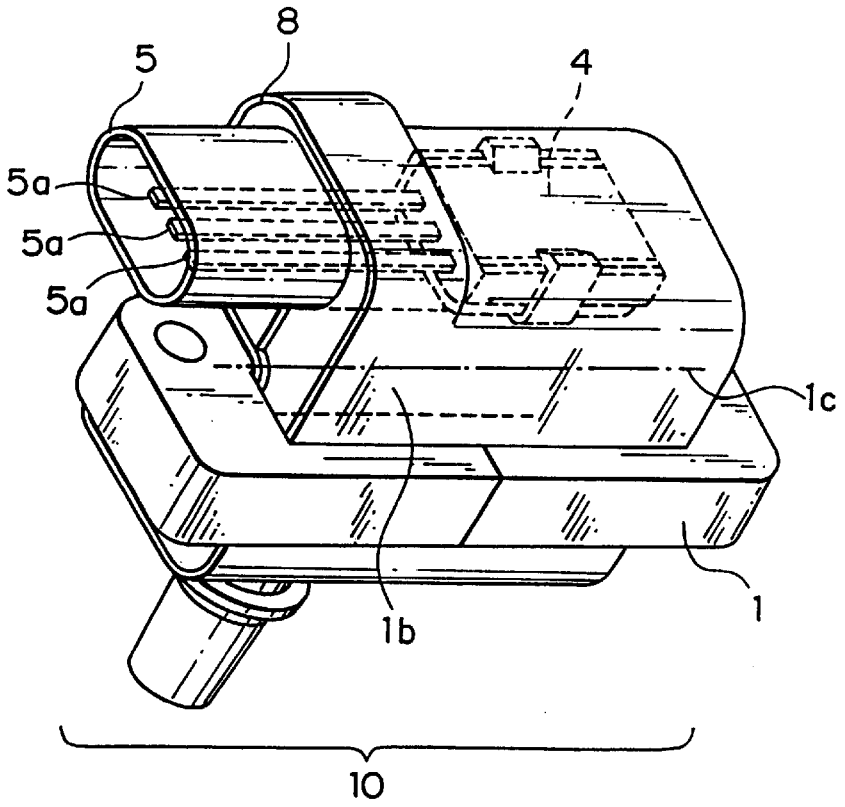
FIG. 9 is a perspective view showing an example of a conventional ignition coil for an internal combustion engine.
Figure 10:
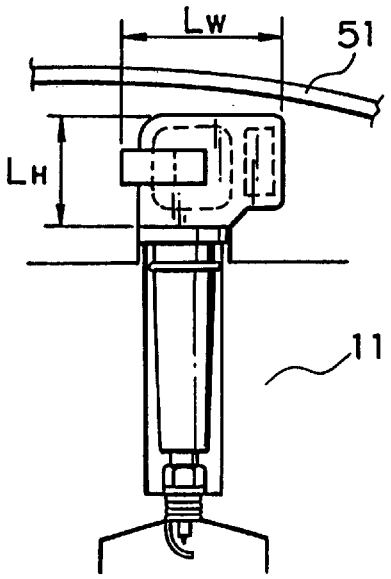
FIG. 10 is a view showing another example of mounting of the conventional ignition coil in the internal combustion engine.
Figure 11:
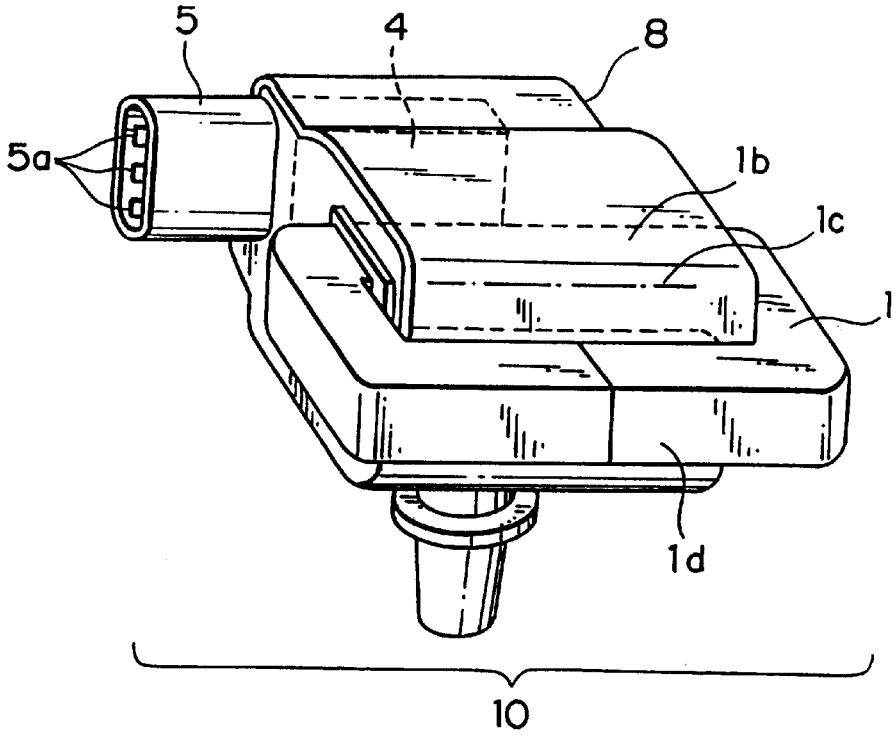
FIG. 11 is a perspective view showing another example of the conventional ignition coil for an internal combustion engine.
Figure 12:
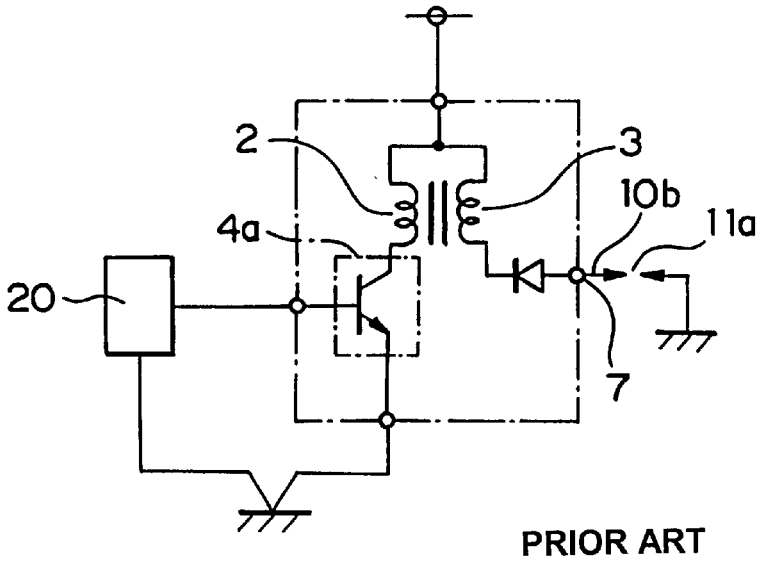
FIG. 12 is a circuit diagram showing the conventional ignition coil for an internal combustion engine.

Table 1 shows the comparing result of two kinds of the prior arts and the product, which was actually made according to the present invention in FIGS. 9 and 11 described above.

TABLE 1

Comparing specification/efficiency of the prior arts and the product made according to the present invention

Figure 6:
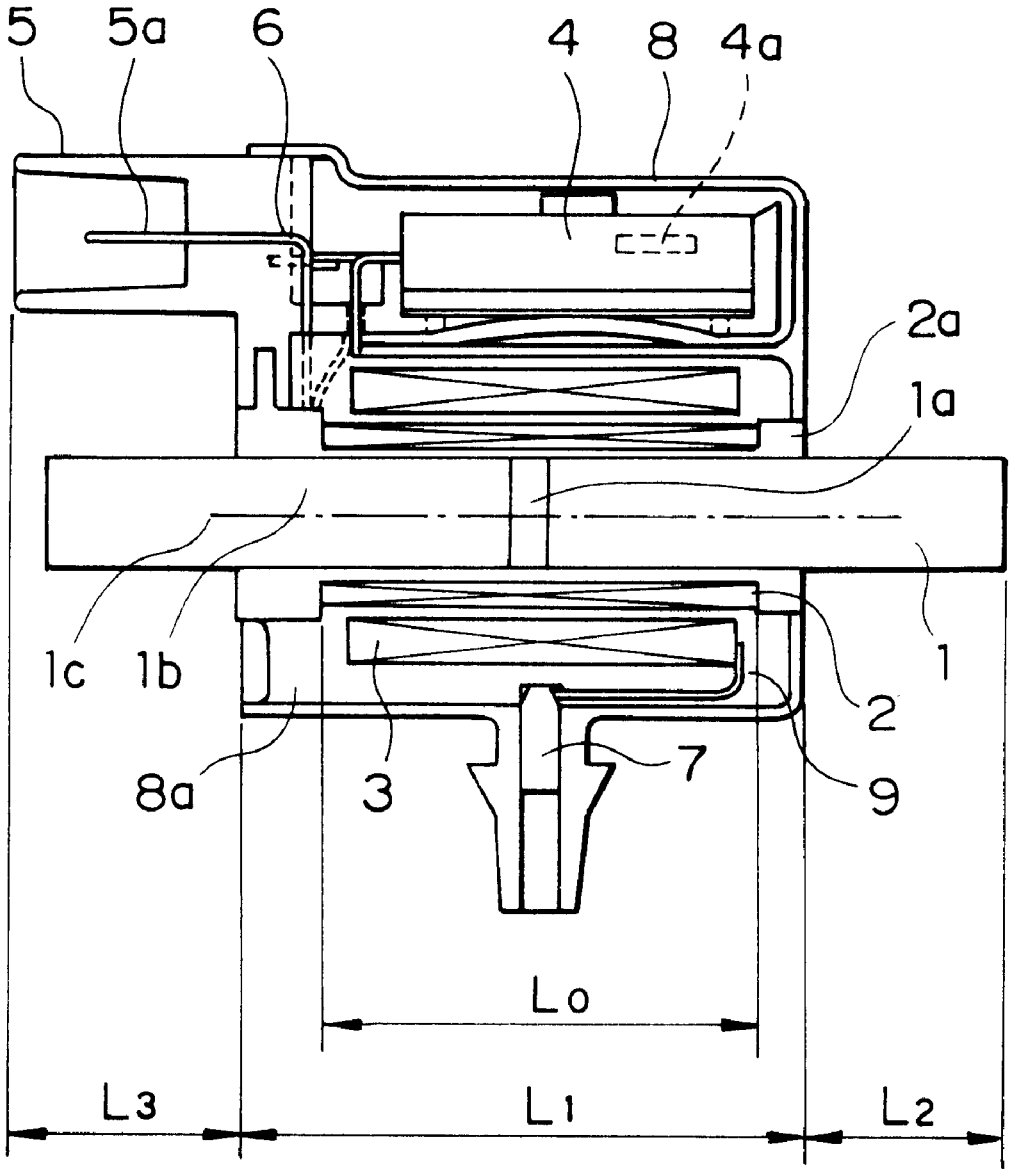
FIG. 6 is a cross sectional view showing an example of a conventional ignition coil for an internal combustion engine.
Figure 7:
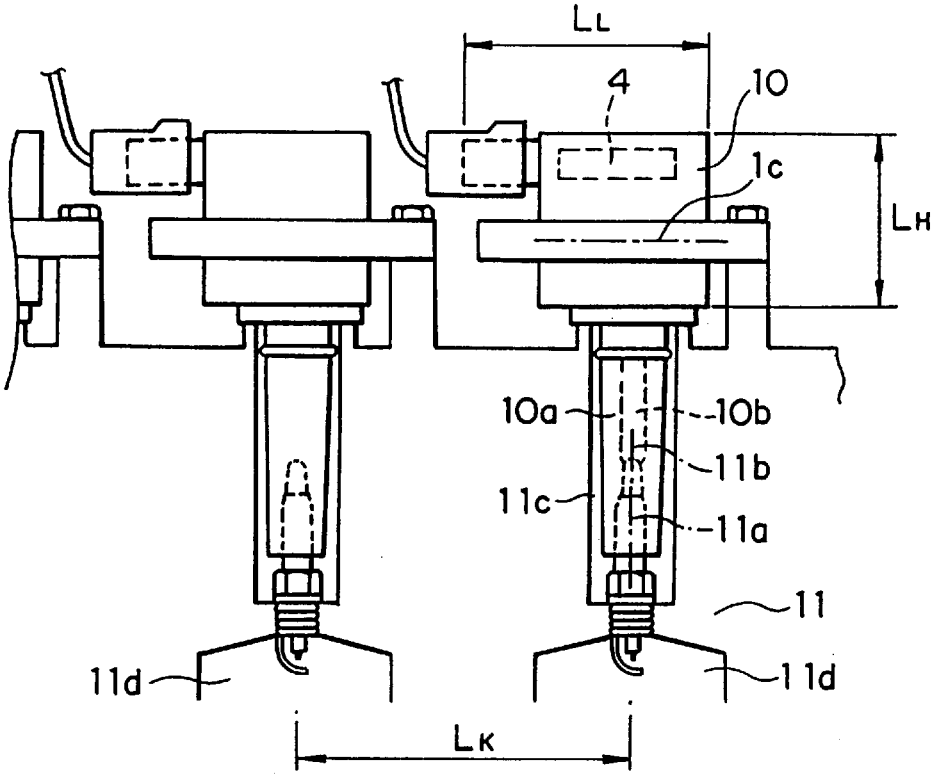
FIG. 7 is a view showing an example of mounting of a conventional ignition coil in the internal combustion engine.
Figure 8:
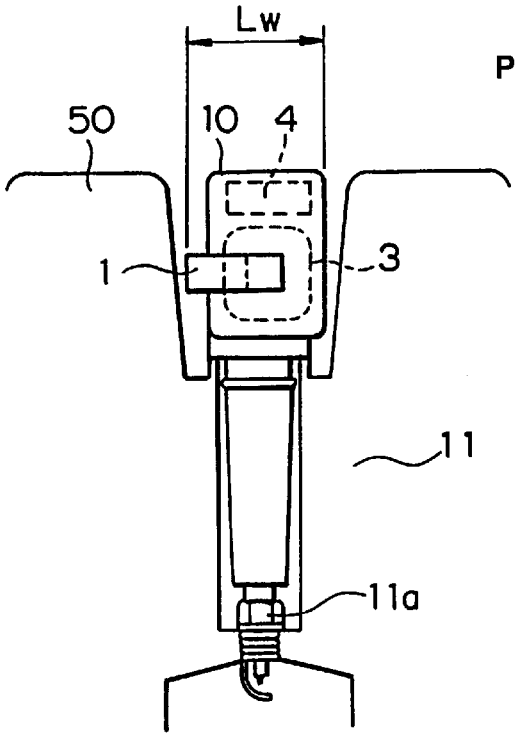
FIG. 8 is a view showing an example of mounting of a conventional ignition coil in the internal combustion engine.

| Specification/ Efficiency | Prior art Example 1 (FIG. 8) | Prior art Example 2 (FIG. 11) | Present invention (FIG. 6) |
|---|---|---|---|
| Disposition of switching unit | Parallel to top of actuated magnetic portion | Parallel to side of actuated magnetic portion | Vertical to end of actuated magnetic portion |
| Cross section area of actuated magnetic portion | 72 $mm^2$ | ← | ← |
| Material of iron core | Magnetic steel plate with characteristics of non-direction | ← | Magnetic steel plate with characteristics of direction |
| Turn number of primary coil | 150 turn | ← | 105 turn |
| Length of primary coil | 37.5 mm | ← | 26.5 mm |
| Interception current | 6.5 A | ← | 7.5 A |
| Gap magnet | Disposition of actuated magnetic portion(IN) | ← | Disposition of actuated magnetic portion(OUT) |
| Output energy | 55 mJ | ← | ← |
| Height of periphery dimension $L_H$ | 38 mm | 28 mm | ← |
| Width of periphery dimension $L_W$ | 35 mm | 45 mm | 35 mm |
| Length of periphery dimension $L_L$ | 81 mm | ← | ← |
| Body weight of ignition coil | 170 g | ← | 160 g |

In Table 1, as the prior art 1, as the switching unit 4 is disposed in parallel at the top of the actuated magnetic portion, the width $L_W$ of the periphery of the ignition coil is narrow but the height $L_H$ of that is high. In the example 2 of the prior art, as the switching unit 4 is disposed in parallel at the side of the actuated magnetic portion, the width $L_H$ of the periphery of the ignition coil is low but the width $L_W$ of that is large. As for the ignition coil of this embodiment, both the height $L_H$ and width $L_W$ of the periphery dimension are equal to each smaller dimension of the conventional ignition coil and the length $L_L$ is also equal to that of conventional one.

The ignition coil of this embodiment may be mounted to any internal combustion engine to which the conventional ignition coil is mounted. Furthermore it is clear that we can submit the ignition coil which is able to be mounted to the severe layout of the internal combustion engine which is limited both for the height and the width. This ignition coil is able to reduce the cost greatly by reducing the kind of products for a case or the like and investment for the equipment, and reducing the labor cost for the production process and increase the production quantity for the each equipment.

In this embodiment, it is not necessary to adopt all technologies to shorten the axis length of the actuated magnetic portion (the winding length of the primary coil) as shown above. It is reasonable that the suitable technologies should be applied according to the required specification to realize this embodiment.

Embodiment 2

Figure 3:
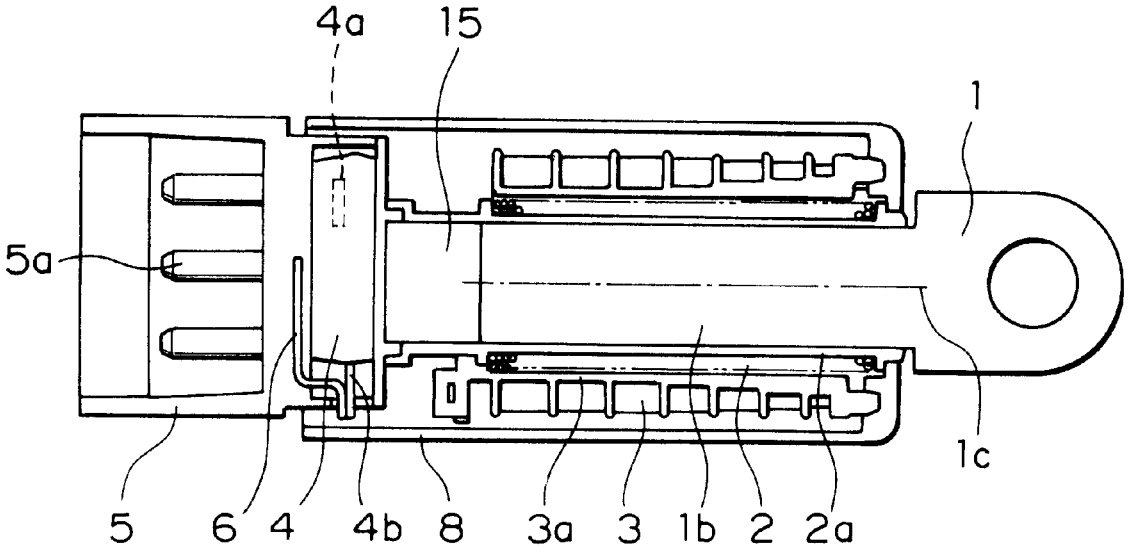
FIG. 3 is a plain cross sectional view showing an ignition coil for an internal combustion engine according to Embodiment 2 of the present invention.
Figure 4:
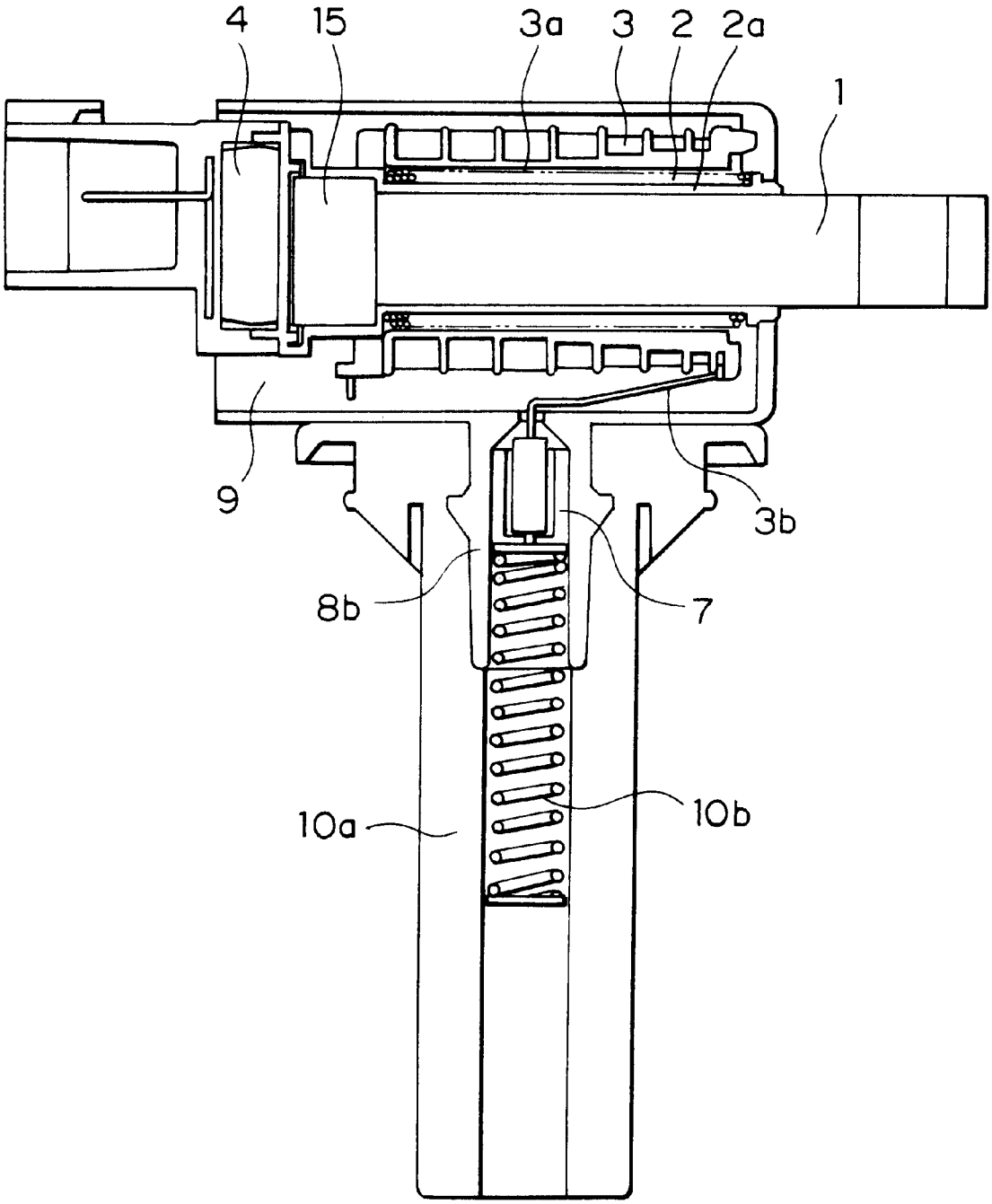
FIG. 4 is a side cross sectional view showing the ignition coil for an internal combustion engine according to Embodiment 2 of the present invention.

In Embodiment 1 described above, the ignition coil applied to the closed magnetic circuit iron core was explained. However it may be applied to the open magnetic iron core too. FIG. 3 is a plain cross section view in the case where the open magnetic core is applied. FIG. 4 is a side cross section view of FIG. 3. As the relation between each referential numeral and number is as same as that of FIGS. 1 and 2, the explanation will be omitted.

The difference between FIGS. 1 and 2 and FIGS. 3 and 4 will be explained below. Referential numeral 1 denotes the open magnetic iron core and the referential numeral 15 denotes the magnet which disposed at the left end of the iron core 1 having a polarity of the opposite direction against the actuated magnetic direction of the iron core caused by the primary coil 2. In this embodiment, the motion of the ignition coil is as same as that of the conventional one. Therefore the detailed explanation will be omitted.

Next in this embodiment, the motion of the ignition coil will be explained below.

If the ignition coil in the open magnetic circuit has the equal turn number of primary coil to that in the open magnetic circuit, the primary current dash dashes rapidly and the output efficiency becomes low. In order to get the same output efficiency as that in case of the closed magnetic circuit, the turn number of the primary coil shall be multiplied by 1.5 to 2.

Recently in order to get a spurting of an air-fuel mixture , the multi spark ignition under the low output energy is being examined. For that application, the ignition coil of this embodiment will be effective.

The ignition coil according to this embodiment may be still minimized so that the shape of the ignition coil will be able to be smaller than that of preferred Embodiment 1. Therefore the ignition coil of this embodiment may be mounted to any internal combustion engine to which the conventional ignition coil is mounted. Furthermore it is clear that we can submit the ignition coil which is able to be mounted to the severe layout of the internal combustion engine which is limited both for the height and the width. This ignition coil is able to reduce the cost greatly by reducing the kind of products for the case and investment for the equipment, and reducing the labor cost for the production process and increase the production quantity for the each equipment.

What is claimed is:

1. An ignition coil for an internal combustion engine, comprising:

an actuated magnetic portion of an iron core which has an axis line crossing an ignition plug axis line of the internal combustion engine at a right angle and around which a primary coil is wound; and a switching unit which is disposed at an end of the actuated magnetic portion vertically to the axis line of the actuated magnetic portion and flows and intercepts a primary current flowing through the primary coil.

2. The ignition coil for an internal combustion engine according to claim 1, wherein a cross section area of the iron core is 50 $mm^2$ or larger.

3. The ignition coil for an internal combustion engine according to claim 1, further comprising a case that has the actuated magnetic portion and the switching unit built-in, wherein a length of the case in an axis line direction of the actuated magnetic portion is shorter than 60 mm.

4. The ignition coil for an internal combustion engine according to claim 1, wherein a material of the iron core is a magnetic steel plate having direction characteristics in the axis line direction of the actuated magnetic portion the actuated magnetic portion.

5. The ignition coil for an internal combustion engine according to claim 1, wherein an element of the switching unit is a switching element that intercepts a current at 7.5 A or larger.

6. The ignition coil for an internal combustion engine according to claim 1, wherein the iron core is a closed magnetic circuit iron core having a gap.

7. The ignition coil for an internal combustion engine according to claim 6, wherein the gap of the closed magnetic circuit iron core is formed outside of the actuated magnetic portion.

8. The ignition coil for an internal combustion engine according to claim 6, further comprising a side iron core portion which is connected to the actuated magnetic portion at a part of the closed magnetic circuit iron core, is disposed between the actuated magnetic portion and the switching unit, and has a cross section that is almost equal to that of the actuated magnetic portion, wherein a cross section shape of the side iron core portion is a rectangular shape that has a shorter side in the direction of the axis line of the actuated magnetic portion.

9. The ignition coil for an internal combustion engine according to claim 1, wherein the iron core is an open magnetic circuit iron core.

* * * * *